US009789358B2

(12) United States Patent
An

(10) Patent No.: US 9,789,358 B2
(45) Date of Patent: Oct. 17, 2017

(54) EXERCISE BAR MOUNTED ON DOOR FRAME

(71) Applicant: Tae Jin An, Incheon (KR)

(72) Inventor: Tae Jin An, Incheon (KR)

( * ) Notice: Subject to any disclaimer, the term of this patent is extended or adjusted under 35 U.S.C. 154(b) by 0 days.

(21) Appl. No.: 14/948,632

(22) Filed: Nov. 23, 2015

(65) Prior Publication Data

US 2016/0144230 A1 May 26, 2016

(30) Foreign Application Priority Data

Nov. 24, 2014 (KR) ..... 10-2014-0164558

(51) Int. Cl.

| | |
|---|---|
| ***A63B 21/16*** | (2006.01) |
| ***A63B 23/12*** | (2006.01) |
| ***A63B 1/00*** | (2006.01) |
| ***A63B 21/068*** | (2006.01) |
| ***A63B 21/00*** | (2006.01) |

(52) U.S. Cl.

CPC ..... *A63B 23/1218* (2013.01); *A63B 1/00* (2013.01); *A63B 21/068* (2013.01); *A63B 21/1627* (2013.01); *A63B 21/4035* (2015.10)

(58) Field of Classification Search

CPC ..... A63B 21/1618; A63B 21/1627; A63B 21/1636; A63B 21/1645; A63B 21/1654; A63B 21/1663

See application file for complete search history.

(56) References Cited

U.S. PATENT DOCUMENTS

| | | | | |
|---|---|---|---|---|
| 3,642,278 | A | 2/1972 | Hinckley | |
| 4,527,797 | A | 7/1985 | Slade, Jr. et al. | |
| 4,529,191 | A | 7/1985 | Miller et al. | |
| 7,621,847 | B2 * | 11/2009 | Lamle | A63B 21/00181 482/39 |
| 2015/0148197 | A1 * | 5/2015 | Lentz | A63B 1/00 482/40 |

FOREIGN PATENT DOCUMENTS

| | | | |
|---|---|---|---|
| KR | 2013-0093219 | A | 8/2013 |
| KR | 101298882 | B1 | 8/2013 |
| KR | 101322472 | B1 | 10/2013 |
| KR | 101341253 | B1 | 12/2013 |

OTHER PUBLICATIONS

Office Action issued in corresponding Chinese Application No. 201510810537.9 dated Jun. 20, 2017, and English translation thereof (18 pages).

* cited by examiner

*Primary Examiner* — Loan H Thanh
*Assistant Examiner* — Rae Fischer
(74) *Attorney, Agent, or Firm* — Osha Liang LLP

(57) ABSTRACT

The present invention relates to an exercise bar mounted on a door frame, and to an exercise bar mounted on a door frame capable of preventing a user's face or head from hitting an edge part of an upper end of the door frame when a user bends her or his arms to pull her or his upper body upward and hang her or his chin on a horizontal rod during an exercise such as a chin-up, and in which a height of a pipe member installed at the door frame can be adjusted according to a height of the user.

5 Claims, 6 Drawing Sheets

EXERCISE BAR MOUNTED ON DOOR FRAME

CROSS-REFERENCE TO RELATED APPLICATION

This application claims priority to and the benefit of Korean Patent Application No. 2014-0164558, filed on Nov. 24, 2014, the disclosure of which is incorporated herein by reference in its entirety.

BACKGROUND

1. Field of the Invention

The present invention relates to a sports apparatus, and more specifically, to an exercise bar mounted on a door frame that is installed between opposite sides of the door frame in a transverse direction allowing a user to stretch her or his full body and strengthen her or his upper-body muscles.

2. Discussion of Related Art

Generally, an exercise bar mounted on a door frame which is transversely fixed between opposite sides of the door frame to facilitate indoor chin-ups is known.

Such an exercise bar mounted on a door frame may be used for exercises such as chin-ups, and used as a rod for installing a punching bag, a swing for an infant and the like indoors.

FIG. 1 is a cross-sectional view of an exercise bar mounted on a door frame according to a conventional technique. As illustrated, the exercise bar mounted on the door frame includes: a hollow pipe member 1; a screw member 2 installed in the pipe member 1 in a direction in which the pipe member 1 extends; and length adjusting members 5 connected to both ends of the pipe member 1 through the screw member 2. Also, the exercise bar mounted on the door frame further includes end caps 6 fixed to the door frame, and the end caps 6 are inserted into opposite end parts of the length adjusting member 5, thereby preventing a horizontal bar from slipping from the door frame.

However, since the exercise bar mounted on the door frame according to the conventional technique is installed inside the door frame, a user may hit an edge part of the upper end of the door frame during a chin-up, and thus there has been a problem of high possibility of injury to a user's face or head.

Also, since a door frame of a typical home at which an exercise bar mounted on a door frame is installed does not have a height at which users who have various physical conditions, especially various heights, can freely exercise, when the exercise bar is installed at a high position for tall users, it is difficult for small users to do chin-ups, and thus there has been a problem in that many users who have various heights cannot control the height of the exercise bar to fit to their height to do chin-ups.

(Patent Document 1) Korean Laid-open Patent Application No. 1341253 (Published on Dec. 6, 2013)

SUMMARY OF THE INVENTION

To solve this problem the present invention provides an exercise bar mounted on a door frame capable of preventing a user's face or head from hitting an edge part of an upper end of the door frame even when the user pulls her or his upper body upward by bending her or his arms and hangs her or his chin on a horizontal bar during an exercise such as a chin-up.

Also, another object of the present invention is to provide an exercise bar mounted on a door frame in which a height of a pipe member installed on a door frame can be adjusted depending on a height of a user.

According to an aspect of the present invention, there is provided an exercise bar mounted on a door frame according to a first embodiment of the present invention including hinge members fixed to the door frame, support brackets rotatably installed on the hinge members, and a first pipe fixed between the support brackets in a transverse direction and installed to be supported at a front of the door frame.

According to another aspect of the present invention, there is provided an exercise bar mounted on a door frame according to a second embodiment of the present invention including hinge members fixed to the door frame; support brackets rotatably installed on the hinge members; a first pipe fixed between the support brackets in a transverse direction; and a second pipe fixed between the support brackets in a transverse direction and installed to be supported at a front of the door frame.

According to still another aspect of the present invention, there is provided an exercise bar mounted on a door frame according to a third embodiment of the present invention including hinge members fixed to the door frame; support brackets rotatably installed on the hinge members and including a plurality of height-adjusting holes; a first pipe fixed between the support brackets in a transverse direction; and a second pipe selectively inserted into the height-adjusting holes and installed to be supported at a front of the door frame.

The hinge member may include a circular plate fixed to the door frame; and a support plate provided at a side surface of the circular plate, having a larger diameter than the circular hole of the support bracket into which the circular plate is inserted, and preventing the support bracket from escaping.

The support bracket may include a circular hole provided at one side thereof and into which the circular plate of the hinge member is rotatably inserted; and a first pipe fixing hole provided at the other side thereof and into which the first pipe is inserted.

The support bracket may include a circular hole provided at one side thereof and into which the circular plate of the hinge member is rotatably inserted; a first pipe fixing hole provided at the other side thereof and into which the first pipe is inserted; and a second pipe fixing hole provided at a lower part between the circular hole and the first pipe fixing hole and into which the second pipe is inserted.

The support bracket may include a circular hole provided at one side thereof and into which the circular plate of the hinge member is rotatably inserted; a first pipe fixing hole provided at the other side thereof and into which the first pipe is inserted; and a plurality of height-adjusting holes provided at a lower part between the circular hole and the first pipe fixing hole.

A width of the support bracket may be relatively smaller than a width of the circular plate so that the support bracket can be easily rotated with respect to the circular plate without interference from the support plate.

The hinge member may be fastened with a fastening member of the support plate at a position at which the fastening member of the support plate does not interfere with the fastening member of the circular plate and the circular plate and the support bracket may be attached to each other by the support plate and are fixed to the door frame.

The first pipe fixing hole may include a key groove formed on one side thereof into which a fixing key is inserted and fixed, and the fixing key may have one side surface for insertion in which a flat surface and a slope surface are continuously and repeatedly formed to be inclined upward.

According to the exercise bar mounted on the door frame according to the present invention of the above-described configuration, a user can do chin-ups in safety and with correct posture by using the exercise bar mounted on the door frame protruding outward from the door frame.

Also, a user can do chin-ups under optimal exercise conditions by adjusting a height of a pipe member depending on a height of the user.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereafter, embodiments of the present invention will be described in detail with reference to FIGS. 2 to 8.

Figure 1:
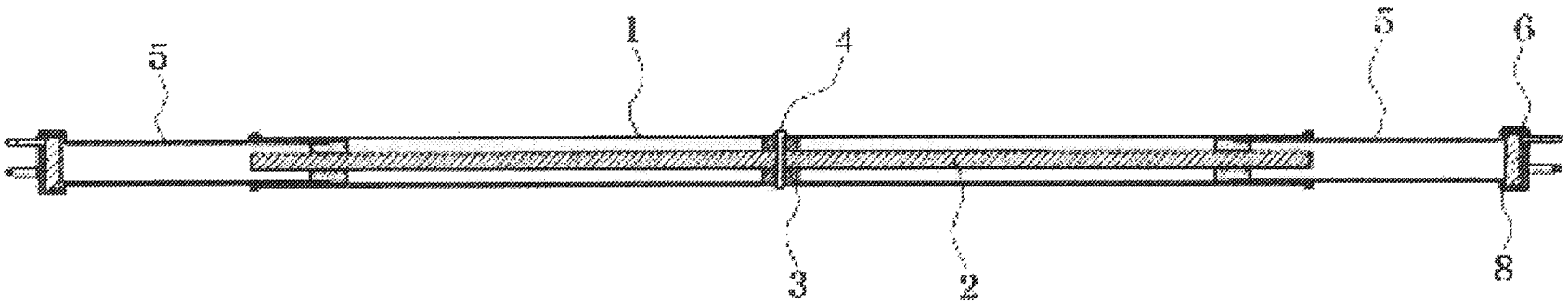
FIG.1 (Prior Art)
FIG. 1 is an view illustrating an exercise bar for mount in a door frame according to a conventional technique.
Figure 2:
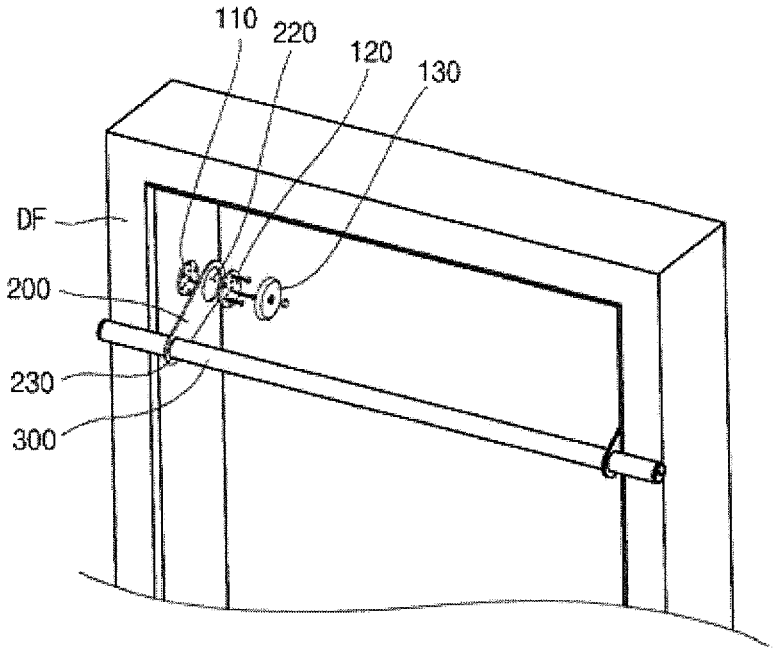
FIG. 2 is an exploded perspective view illustrating an exercise bar mounted on a door frame according to a first embodiment of the present invention.

FIG. 2 is an exploded perspective view illustrating an exercise bar mounted on a door frame according to a first embodiment of the present invention.

The exercise bar mounted on the door frame according to the first embodiment of the present invention, which is fixedly installed to correspond to opposite surfaces of the door frame, includes hinge members 100 fixed to the door frame DF, support brackets 200 rotatably installed on the hinge members 100, and a first pipe 300 fixed between the support brackets 200 in a transverse direction and installed to be supported at a front of the door frame DF.

It is preferable that the first pipe 300 be manufactured to be light-weight and have a minimized circumferential thickness. Further, even if the first pipe 300 is made of a light-weight material, it is possible to have a sufficient strength.

Figure 3:
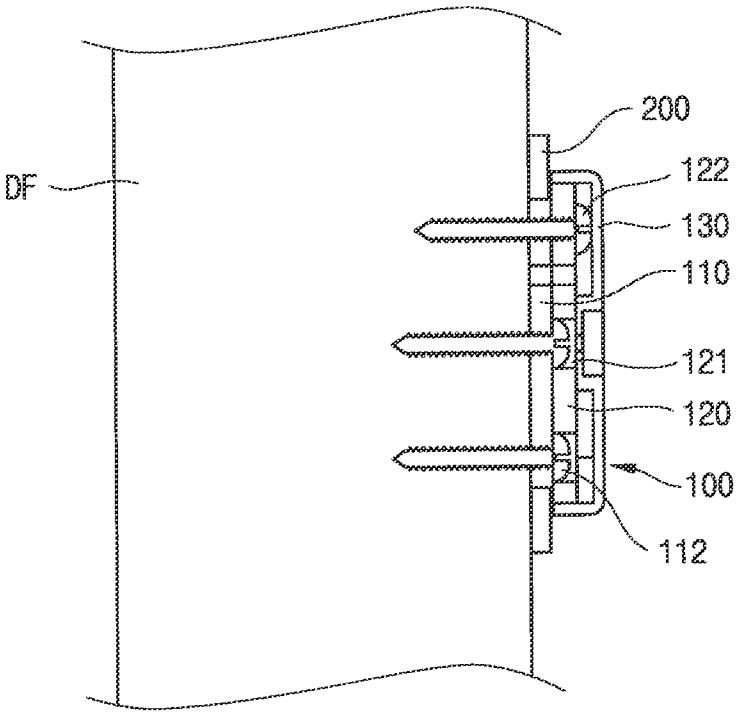
FIG. 3 is a cross-sectional view illustrating a hinge member of the exercise bar mounted on the door frame according to first and third embodiments of the present invention.
Figure 4:
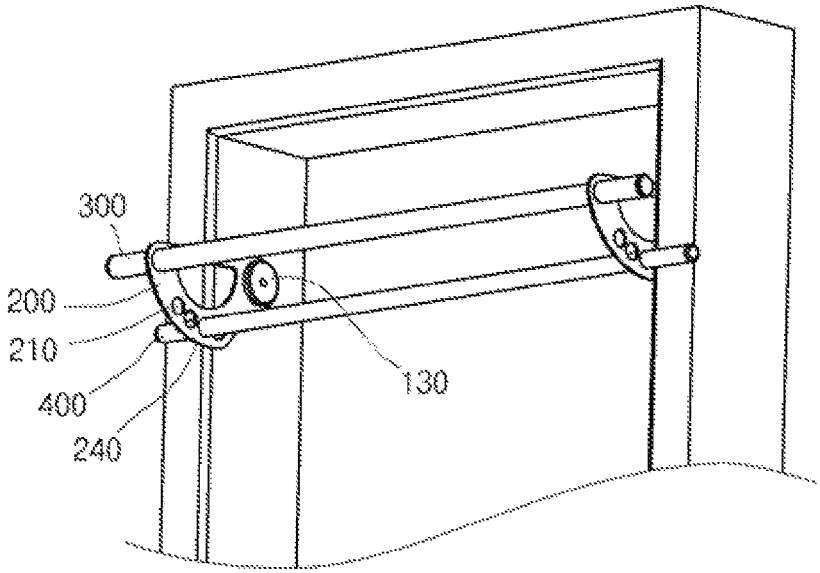
FIG. 4 is an view illustrating the exercise bar mounted on the door frame according to the third embodiment of the present invention.
Figure 5:
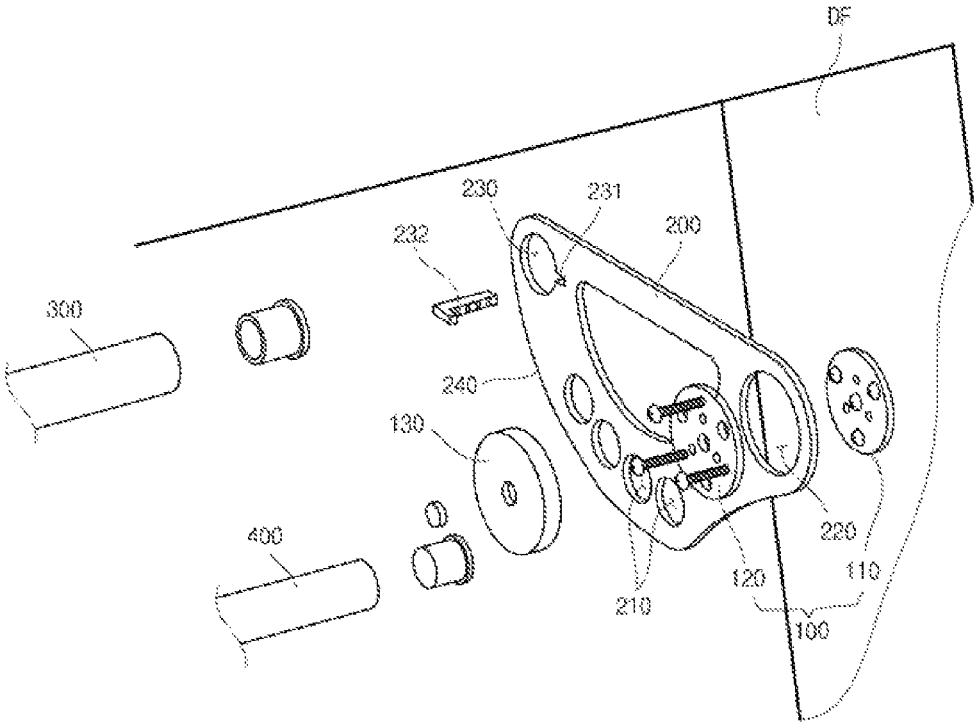
FIG. 5 is an exploded perspective view on an end side of the exercise bar mounted on the door frame according to the third embodiment of the present invention.

FIG. 3 is a cross-sectional view illustrating the hinge member 100 of the exercise bar mounted on the door frame according to the present invention. The hinge member 100 includes a circular plate 110 and a support plate 120. The circular plate 110 is fixed to the door frame DF through a circular plate fastener 112 such as a screw, and the support plate 120 is provided at a side surface of the circular plate. The support plate 120 is fixed to a side surface of the circular plate 110 through a support plate fastner 122 such as a screw and supports the support bracket 200 to rotate without escaping from the door frame DF.

The support bracket 200 includes a circular hole 220 formed on one side thereof and into which the circular plate 110 of the hinge member 100 is inserted, and a first pipe fixing hole 230 formed on the other side thereof and into which the first pipe 300 is inserted. The support bracket 200 is supported on the circular plate 100 to be rotatable.

A width of the support bracket 200 is relatively smaller than the width of the circular plate 110 so that the support bracket 200 is easily rotated without interference from the support plate 120 at the time of rotation with respect to the circular plate 110, and it is preferable that a diameter of the support plate 120 be larger than the diameter of the circular plate 110 and the diameter of the circular hole 220 formed on the support bracket 200. Therefore, the support bracket 200 is rotatably supported on the hinge member 100 and prevented from escaping from the hinge member 100.

The support plate fastener 122 for the support plate 120 is fastened at a position at which the support plate fastener 122 for the support plate 120 does not interfere with the circular plate fastener 112 for the circular plate 110 so that the circular plate 110 and the support bracket 200 can be attached to each other by the support plate 120 and fixed to the door frame DF, and the support plate 120 includes a head fixing hole 121 into which a head part of the circular plate fastener 112 that is fastened to the circular plate 110 and protrudes outward is inserted.

A support plate cover 130 with a cup shape is provided at the outside of the support plate 120 to improve the appearance of the hinge member 100.

The hinge member 100 may be applied to the first to third embodiments of the present invention.

According to the exercise bar mounted on the door frame according to the first embodiment of the present invention, the first pipe 300 is inserted into the first pipe fixing holes 230 to be supported at the front of the door frame DF, and thus the first pipe 300 may act as a horizontal bar even with one pipe member.

Also, since only the first pipe 300 is installed, installation is easily performed and manufacturing costs and processes are reduced.

Hereinafter, as second and third embodiments of the exercise bar mounted on the door frame according to the present invention are described, components having the same configuration and function as in the first embodiment of the present invention will be denoted by the same reference numerals, and the detailed description will be omitted to avoid repeated elements.

The exercise bar mounted on the door frame according to the second embodiment of the present invention, which is fixedly installed to correspond to opposite surfaces of the door frame, includes hinge members 100 fixed to the door frame DF, support brackets 200 rotatably installed on the hinge members 100, a first pipe 300 fixed between the support brackets 200 in a transverse direction, and a second pipe 400 fixed between the support brackets 200 in the transverse direction to be supported at the front of door frame DF.

According to the second embodiment of the present invention, when a user grips the first pipe 300 to do chin-ups, the user can do chin-ups in safety and with correct posture by using the exercise bar mounted on the door frame protruding outward from the door frame DF. The exercise bar mounted on the door frame according to the second embodiment of the present invention is configured with a simple structure similar to that of the first embodiment, thereby reducing manufacturing costs and processes.

The exercise bar mounted on the door frame according to the third embodiment of the present invention, which is fixedly installed to correspond to opposite surfaces of the door frame, includes hinge members 100 fixed to the door frame DF, support brackets 200 rotatably installed on the hinge members 100 and having a plurality of height-adjusting holes 210, a first pipe 300 fixed between the support brackets 200 in a transverse direction, and a second pipe 400 selectively inserted into the height-adjusting holes 210 and installed to be supported at a front of the door frame DF.

The support bracket 200 includes a plurality of height-adjusting holes 210 formed at a lower part between the circular hole 220 and the first pipe fixing hole 230.

The number of height-adjusting holes 210 may be at least two so that users can exercise under optimal exercise conditions according to their different heights, and may be selectively increased depending on free space of a connection unit 240.

According to the third embodiment of the present invention, when a position of the second pipe 400 inserted into the height-adjusting holes 210 to be fixed is adjusted, a height of the first pipe 300 from the ground is relatively increased or decreased, and thus the height of the pipe member may be adjusted according to the height of the user.

Particularly, when a user desires to use the exercise bar mounted on the door frame at a further decreased height of the first pipe 300, the height may be adjusted to a minimum height in which the first pipe 300 supports the door frame DF, so even a small user may sufficiently use the exercise bar mounted on the door frame.

Figure 6:
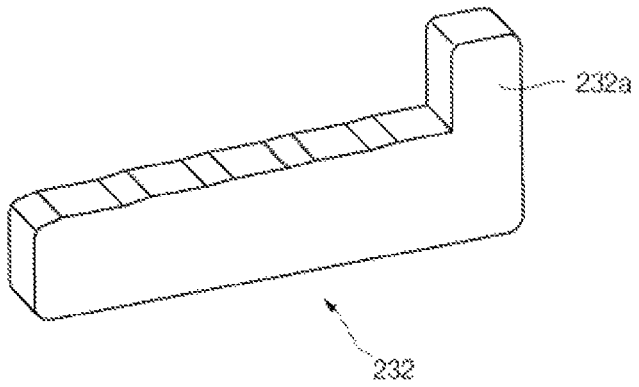
FIG. 6 is a perspective view illustrating a fixing key for fixing a first pipe of the exercise bar mounted on the door frame according to the first to third embodiments of the present invention to a support bracket.

FIG. 6 is a perspective view illustrating a fixing key for fixing the first pipe 300 of the exercise bar mounted on the door frame according to the present invention to the support bracket 200. A key groove 231 is formed on one side of the first pipe fixing hole 230. A fixing key 232 is inserted and fixed into the key groove 231 for the first pipe 300 not to be freely rotated in the first pipe fixing hole 230. The first pipe fixing hole 230 is in the form of an ellipse, one side of which is a little longer than the external diameter of the first pipe 300. When the first pipe 300 are inserted in the first fixing holes 230 and the fixing keys 232 are inserted and fixed into the key grooves 231, the outer surface of the first pipe 300 is pressurized by the fixing keys 232, so the rotation of the first pipe 300 can be prevented.

Here, the fixing key 232 has a bar shape having one side on which a grip 232*a* is formed and has one side surface for insertion in which a flat surface and a sloped surface are continuously and repeatedly formed to be inclined upward, thereby improving fastening of the first pipe 300 to the first pipe fixing holes 230 while the fixing key 232 is inserted into the key groove 231.

When the fixing key 232 is fixed to the key groove 231 in a forcible manner while the first pipe 300 is inserted into the first pipe fixing holes 230, free rotation of the first pipe 300 in the first pipe fixing holes 230 is prevented.

Therefore, when the user grips the first pipe 300, the first pipe 300 is not freely rotated in the first pipe fixing holes 230, and thus the user can comfortably do chin-ups.

The configuration of the key groove 231 and the fixing key 232 may be applied to all of the first to third embodiments of the present invention.

Meanwhile, as the operation of the exercise bar mounted on the door frame of the first to third embodiments of the present invention is described, when the exercise bar mounted on the door frame in which a height can be adjusted is installed, firstly, the circular plates 110 of the hinge members 100 are fixed to both sides of the door frame DF, and then the support plates 120 are strongly fixed from the outside of the support brackets 200 while the circular holes 220 of the support brackets 200 corresponding to the circular plates 110 correspond to each other.

While the support brackets 200 are fixed to the hinge members 100, according to the first embodiment, the user strongly fixes the first pipe 300 by inserting the first pipe 300 into the first pipe fixing holes 230 according to her or his height, and inserting the fixing key 232 into the key groove 231.

Next, the first pipe 300 is supported on the front of the door frame DF, and the user does chin-up while gripping the first pipe 300.

In the second embodiment of the present invention, while the circular plates 110 of the hinge members 100 are fixed to opposite sides of the door frame DF and the circular holes 220 of the support brackets 200 corresponding to the circular plates 110 correspond to each other, the support plate 120 is strongly fixed from the outside of the support bracket 200.

While the support brackets 200 are fixed to the hinge members 100, according to the second embodiment, the first pipe 300 is inserted into the first pipe fixing holes 230, the fixing key 232 is inserted into the key groove 231 to be strongly fixed, and the second pipe 400 is inserted into a second pipe fixing hole (not shown) to be fixed.

Next, the second pipe 400 is supported on the front of the door frame DF, and the user does chin-ups while gripping the first pipe 300.

In the third embodiment of the present invention, while the circular plates 110 are fixed to the hinge members 100 on both sides of the door frame DF and the circular holes 220 of the support brackets 200 corresponding to the circular plates 110 correspond to each other, the support plates 120 are strongly fixed from the outside of the support bracket 200.

While the support brackets 200 are fixed to the hinge members 100, according to the third embodiment, the user inserts the first pipe 300 into the first pipe fixing holes 230 and inserts the fixing key 232 into the key groove 231 to be strongly fixed, thereby fixing the second pipe 400 to the height-adjusting hole 210 according to the height of the user. Next, the second pipe 400 is supported at the front of the door frame DF, and the user does chin-ups while gripping the first pipe 300.

Next, the second pipe 400 is supported on the front of the door frame DF, and the user does chin-ups while gripping the first pipe 300.

Figure 7:
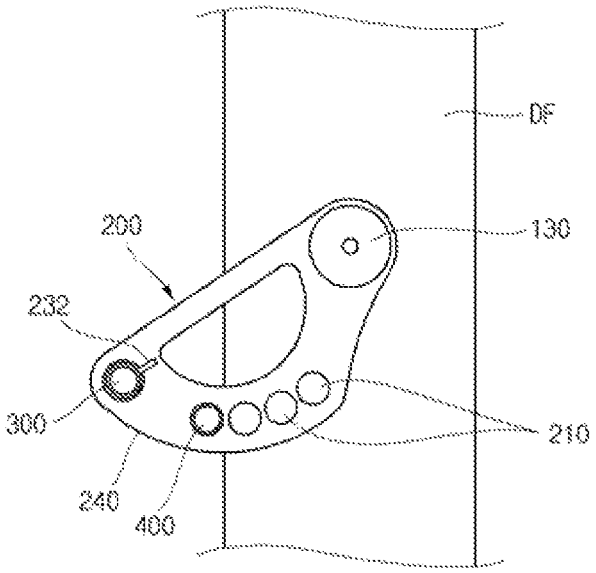
FIGS. 7 and 8 are operation views illustrating a height control state of the exercise bar mounted on the door frame according to the third embodiment of the present invention.
Figure 8:
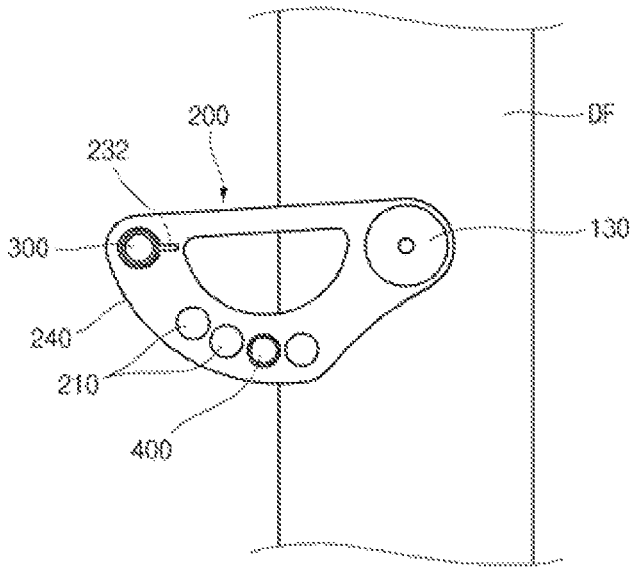

FIGS. 7 and 8 are operation views illustrating a height control state of the exercise bar mounted on the door frame according to the third embodiment of the present invention. When the second pipe 400 inserted and fixed into the height-adjusting hole 210 according to the height of the user is fixed to be adjacent to the first pipe 300, a relatively small user may use the exercise bar mounted on the door frame (FIG. 7). On the other hand, when the second pipe 400 is fixed to be relatively further from the position of the first pipe 300, a relatively tall user may use the exercise bar mounted on the door frame (FIG. 8).

Therefore, the exercise bar mounted on the door frame can allow the user to do chin-ups under optimal exercise conditions according to her or his height.

While exemplary embodiments of the present invention have been described above, the invention is not limited to the aforementioned specific exemplary embodiments. Those skilled in the art may variously modify the invention without departing from the gist of the invention claimed by the appended claims and the modifications are within the protective scope of the claims.

DESCRIPTION OF SYMBOL

100: HINGE MEMBER
110: CIRCULAR PLATE
120: SUPPORT PLATE
121: HEAD FIXING HOLE
130: SUPPORT PLATE COVER
200: SUPPORT BRACKET
210: HEIGHT-ADJUSTING HOLE
220: CIRCULAR HOLE
230: FIRST PIPE FIXING HOLE
231: KEY GROOVE
232: FIXING KEY
240: CONNECTION UNIT
300: FIRST PIPE
400: SECOND PIPE

What is claimed is:

1. An exercise bar mounted on a door frame comprising:

two hinges, each hinge including a circular plate fixed to the interior surface of the door frame and a support plate provided adjacent to the circular plate, wherein the circular plate and the support plate are fixed to the door frame, such that the hinges are fixed to opposing sides of the door frame;

a pair of support brackets, each support bracket rotatably installed on one of the hinges, and comprising:

a circular hole, provided at one end of the support bracket, into which the circular plate of one hinge is inserted, wherein the support plate of the inserted hinge has a larger diameter than the circular hole to prevent the support bracket from escaping from the hinge;

a first pipe fixing hole provided at the opposite end of the support bracket from the circular hole; and a second pipe fixing hole provided between and below the circular hole and the first pipe fixing hole;

a first pipe having two ends, wherein the first pipe ends are inserted through the first pipe fixing holes of opposing support brackets, such that the first pipe is fixed in a transverse direction between the support brackets; and a second pipe having two ends, wherein the second pipe ends are inserted through the second pipe fixing holes of opposing support brackets, such that the second pipe is in a transverse direction between the support brackets and supported at a front side of the door frame to prevent the support brackets from rotating downward.

2. The exercise bar of claim 1, wherein each support bracket further comprises a third pipe fixing hole provided between and below the circular hole and the first pipe fixing hole and configured to allow adjustment of the height of the first pipe by selectively inserting the second pipe in the second pipe fixing hole or the third pipe fixing hole.

3. The exercise bar of claim 1, wherein each hinge further comprises a circular plate fastener fixing the circular plate to the respective interior surface of the door frame and a support plate fastener fixing the support plate to the respective interior surface of the door frame such that the support plate fastener is fixed through both the circular plate and the support plate.

4. The exercise bar of claim 3, wherein the support plate further includes a head fixing hole into which a head part of the circular plate fastener protrudes.

5. The exercise bar of claim 1, wherein the first pipe fixing hole includes a key groove formed on one side into which a fixing key is inserted.

* * * * *